US006162132A

United States Patent [19]

Yoneyama

[11] Patent Number: 6,162,132

[45] Date of Patent: Dec. 19, 2000

[54] GOLF CLUB HEAD HAVING HOLLOW METAL SHELL

[75] Inventor: Minoru Yoneyama, Mishima-gun, Japan

[73] Assignee: Yonex Kabushiki Kaisha, Tokyo, Japan

[21] Appl. No.: 09/312,052

[22] Filed: May 17, 1999

[30] Foreign Application Priority Data

Feb. 25, 1999 [JP] Japan ..... 11-048846

[51] Int. Cl.[7] ..... A63B 53/04

[52] U.S. Cl. ..... 473/338; 473/345; 473/349

[58] Field of Search ..... 473/324, 328, 473/345, 346, 334, 335, 336, 337, 338, 339, 344, 409, 349

[56] References Cited

U.S. PATENT DOCUMENTS

| | | |
|---|---|---|
| 3,652,094 | 3/1972 | Glover . |
| 5,935,019 | 8/1999 | Yamamoto . |
| 5,967,905 | 10/1999 | Nakahara . |

FOREIGN PATENT DOCUMENTS

| | | |
|---|---|---|
| 10-94623 | 4/1998 | Japan . |
| 10-234902 | 9/1998 | Japan . |

OTHER PUBLICATIONS

Golf Digest, magazine, May 15, 1992 issue, "The Taylor Made V Metal vs. The Big Bertha".

Golf, magazine, Jan. 1998 issue, p. 33 of the "Equipment Buyer's Guide".

*Primary Examiner*—Sebastiano Passaniti

*Attorney, Agent, or Firm*—Wenderoth, Lind & Ponack, L.L.P.

[57] ABSTRACT

A golf club head of simple structure is provided, in which tungsten balance weights can be fixed to a titanium sole plate with a sufficient bonding strength. A golf club head 2 includes a hollow shell made of titanium or titanium alloy. The shell has a main body 4, a sole plate 6 and a face plate 8 which are integrally welded. Balance weight members 10 made of tungsten are provided on the sole plate 6 as press-fitted into holes 12 arranged between the toe side 6*a* and the heel side 6*b* of the sole plate 6. The balance weight 10 is a disk-like shape and integrally has a flange 10*a* extending radially at an upper end thereof. The flange 10*a* provided at an upper end of each balance weight member 10 abuts to the inner surface of the sole plate 6. Also, there is provided a metal plate 14 which covers and abuts the upper portions of the balance weights 10. An edge portion of the metal plate 14 is bent in the shape of "L" by a thickness of the flange 10*a* of the balance weight member 10, and appropriate points of the edge portion are welded to the inner surface of the sole plate 6.

5 Claims, 1 Drawing Sheet

GOLF CLUB HEAD HAVING HOLLOW METAL SHELL

BACKGROUND OF THE INVENTION

1. Field of the Invention

The present invention relates to a golf club head having a hollow outer shell made of light metals such as titanium or titanium alloy.

2. Related Art

Traditionally a wood club head has been made of a single persimmon block because it is light in weight and has relatively high strength. However, metals are becoming popular as a material for a golf club head instead of wood because it became difficult to find a suitable wood material such as good persimmon and manufacture costs of such wood material became high. Particularly, in recent years, in order to make the sweet area of the golf club head wider, a hollow shell formed of light metals, such as titanium or titanium alloy, are mainly employed as materials for manufacturing a golf club head.

As the volume of the golf club head made of titanium or titanium alloy is increased, the center of gravity of the golf club head begins to take a higher position, which is undesirable from the viewpoint of smooth swing of the golf club.

In order to lower the center of gravity of the golf club head, a typical golf club head made of titanium or titanium alloy includes at least one insert made of tungsten, whose specific gravity is greater than that of titanium, as a balance weight member. The balance weight member is integrally provided at substantially a middle portion of a sole plate of the club head by bonding, screwing or welding to increase a moment of inertia of the club head by lowering a center thereof.

However, it has been difficult to maintain enough bonding strength between the balance weight member and the sole plate by bonding agent only. Even when they are welded, sufficient welding strength cannot be obtained because the sole plate made of titanium and the balance weight member made of tungsten are different metals and their weldability was not sufficient. Further, when it is intended to connect them by screws, preparation of threads in the parts and assembly thereof are very cumbersome.

SUMMARY OF THE INVENTION

In view of the above and other problems, it is an object of the present invention to provide a golf club head having a structure in which at least one balance weight member of tungsten is easily integrated with a sole plate made of titanium or titanium alloy with sufficient strength therebetween.

In order to accomplish the above and other objects, a golf club head according to one aspect of the present invention has a hollow shell formed of titanium or titanium alloy. The shell comprises a sole plate extending between a toe side and a heel side thereof, at least one hole formed through the sole plate substantially at a middle portion of the sole plate, and at least one balance weight member made of tungsten. The weight member is press-fitted into the corresponding hole from the inside of the hollow shell. The balance weight member has a flange portion radially extending at the upper end thereof. The flange portion of the balance weight member abuts against the inner wall surface of the shell around the corresponding hole.

A plurality of holes may be made through the sole plate and aligned in a swinging direction. The balance weight member is press-fitted into each of the holes. A metal plate contacting and covering the upper end of the balance weight member or members may be welded to the inner surface of the sole plate so as to retain the balance weight member or members in the hole or holes.

With respect to the weight ratio of the balance weight members relative to the total weight of the head, the weight of the balance weights is preferably less than 8% of the total weight of the head when the volume of the head is more than 250 cc. When the volume of the head is more than or equal to 150 cc and less than 250 cc, the weight of the balance weight members may preferably be from 8 to 10% of the total weight of the head. The weight of the balance weight members may be more than 10% of the total weight of the head when the volume of the head is less than 150 cc.

Still other objects and advantages of the present invention will become readily apparent to those skilled in this art from the following detailed description, wherein only the preferred embodiment of the invention is shown and described, simply by way of illustration of the best mode contemplated of carrying out the invention. As will be realized, the invention is capable of other and different embodiments, and its several details are capable of modifications in various obvious respects, all without departing from the invention. Accordingly, the drawing and description are to be regarded as illustrative in nature, and not as restrictive.

DESCRIPTION OF THE PREFERRED EMBODIMENTS

Figure 1:
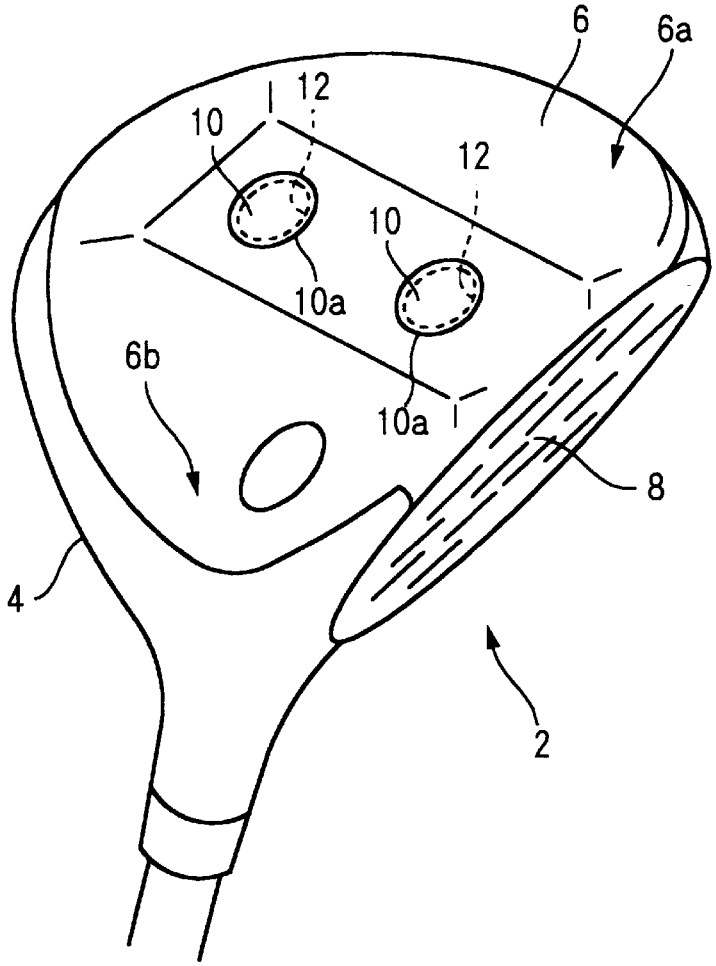
FIG. 1 is a perspective view showing a golf club head according to one embodiment of the present invention.

As shown in the drawings, a golf club head 2 includes a hollow shell made of a light metal such as titanium or titanium alloy. The shell of the club head 2 has three portions, namely, a main body 4, a sole plate 6 and a face plate 8 which are integrally welded.

At least one balance weight member 10 made of tungsten is provided on the sole plate 6. The balance weight member 10 is a disk-like shape and has a flange 10*a* integrally extending radially at an upper end thereof. The sole plate 6 has at least one hole 12 into which the balance weight member is press-fitted. The hole 12 is provided at a center portion between the toe side 6*a* and the heel side 6*b* of the sole plate 6. In other words, the hole 12 is provided substantially at a center portion of the face plate 8 in a width direction. According to the embodiment shown in the drawings of the present invention, two holes 2 are separately made through the sole plate 6 and aligned in the swinging direction of the golf club head. Each hole has the balance weight member 10 press-fitted therein from the inside of the hollow of the head 2. The flange 10*a* provided at the upper end of each balance weight member 10 abuts against the inner surface of the sole plate 6.

Also, there is provided a rectangular-shaped metal plate 14 made of titanium, brass or the like which covers and abuts the upper portions of the two balance weight members 10. Each edge portion of the metal plate 14 is bent in the shape of an "L" by a thickness of the flange 10*a* of the balance weight member 10 and welded at appropriate points of the edge portion to the inner surface of the sole plate 6. The balance weight members 10 and the metal plate 14 are integrally connected to the sole plate 6 before the sole plate 6 is welded to the head body 4.

Although two holes 12 and the corresponding balance weight members 10 are provided in the sole plate 6 according to one embodiment of the invention shown in the drawings, there may be provided three or four holes and balance weight members in the sole plate 6 of the club head 2. Alternatively, there may be provided only one fitting hole and balance weight member, not necessarily a plurality of the same.

According to the golf club head 2 of the above construction, the balance weight members 10 made of tungsten are firmly fixed to each of the holes 12, provided through the sole plate 6 of the head 2 made of titanium, in a simple process of press-fitting, which can be performed from the hollow inside of the head 2. Further, even if the balance weight members are detached from the holes by impacts repeatedly applied to the head 2, the balance weight members do not come out of the head 2. The flange portion 10*a* extending radially at the upper end of each balance weight members 10 prevents the weight members 10 from coming out of the holes 12 due to the abutment with the inner surface around the hole 12. Thus, the golf club head provides sufficient safety.

Further, the balance weight members 10 on the sole plate 6 of the head 2 are provided at a center portion between the toe side 6*a* and the heel side 6*b* of the sole plate 6, which is at the back and substantially middle of the face plate 8 in its width direction. Such an arrangement as above will mean that the weight members of the golf club head 2 are concentrated in an impact zone. Also, the above arrangement of the balance weight members will lower the center of gravity of the head and, as a result of this, a longer flight of golf ball can be accomplished.

Figure 2:
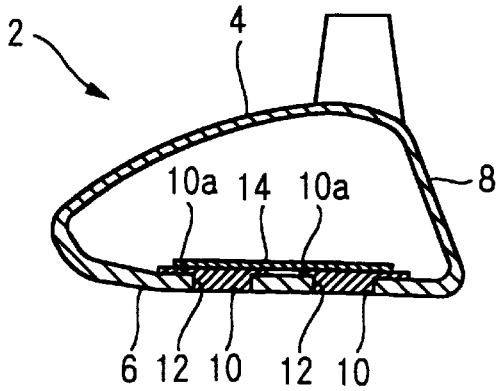
FIG. 2 is a vertical sectional view of the golf club head in FIG. 1.

Moreover, even when the balance weight members 10 collide against small stones or the like while swinging, the balance weight members 10 cannot come off from the sole plate 6 into the inside of the head 2 as they are covered with the metal cover plate 14. More particularly, as shown in FIG. 2, the metal plate cover 14, the periphery of which is welded to the inner surface of the sole plate 6, holds the upper ends of each balance weight member 10 against the inner surface of the hollow portion of the club head 2. To facilitate the welding of the metal cover plate 14 with the sole plate 6, it is preferable to employ titanium as a material for the metal cover plate 14.

It is desirable to change the ratio of the total weight of the balance weight(s) 10 to the total weight of the head according to the volume of the head 2 as described hereinbelow. That is, when the volume of the head 2 is not less than 250 cc, the total weight of the balance weight(s) 10 should be under 8% of the total weight of the head. Further, when the volume of the head 2 is between 150 cc and 250 cc, the total weight of the balance weight(s) 10 should be between 8 and 10% of the total weight of the head. Furthermore, when the volume of the head is under 150 cc, the total weight of the balance weight(s) 10 should be not less than 10% of the total weight of the head.

With such arrangements that the weight ratio of the balance weight members relative to the total weight of the head is increased as the head size becomes smaller, the center of gravity of the head will be lowered as the head size becomes smaller. As it is well known, the golf club head having a lower center of gravity will make it easy to hit the ball higher. Also, when the ball is hit higher, the ball will not run so much after dropping on the ground. Therefore, when the weight ratio of the balance weight members is changed in accordance with the size of the golf club head as set forth above, the golf club having smaller head size such as wood #4 and #5 will make it easy to hit the ball higher and stop the ball closer to the target.

While the present invention has been discussed in terms of the preferred embodiments, the present invention should be implemented in various fashions with incorporating modifications of the disclosed embodiments in addition, omission or modification of the detailed construction, without departing from the principle of the invention. Therefore, the present invention should be understood to include all embodiments encompassed within the spirit of the invention set out in the appended claims.

What is claimed is:

1. A golf club head comprising:

a hollow shell formed of titanium or titanium alloy, and having a toe side and a heel side, said shell comprising a sole plate extending between the toe side and the heel side;

a plurality of holes formed through said sole plate substantially at a middle portion thereof, said holes being aligned in a swinging direction;

a plurality of balance weight members formed of tungsten, said balance weight members being press-fitted from the interior of said hollow shell into said holes, respectively, each of said balance weight members having a radially extending flange portion projecting from an upper end thereof, said flange portion abutting against an inner surface of said sole plate around said respective hole; and a metal plate extending over and covering the upper ends of said plurality of balance weight members, wherein an edge portion of said metal plate is welded to the inner surface of said sole plate so as to retain said plurality of balance weight members in said holes.

2. A golf club head as claimed in claim 1, wherein the weight of said balance weight members is less the 8% of the total weight of said head when the volume of said head is more than 250 cc.

3. A golf club head as claimed in claim 1, wherein the weight of said balance weight members is from 8 to 10% of the total weight of the head when the volume of said head is more than or equal to 150 cc and less than 250 cc.

4. A golf club head as claimed in claim 1, wherein the weight of said balance weight members is more than 10% of the total weight of said head when the volume of said head is less than 150 cc.

5. A golf club head as claimed in claim 1, wherein said metal plate is formed of titanium.

* * * * *